United States Patent [19]

DeLorme

[11] Patent Number: 5,010,810

[45] Date of Patent: Apr. 30, 1991

[54] CAN DISPOSAL APPARATUS

[76] Inventor: Dale J. DeLorme, 4724 Evergreen St., Sheboygon, Wis. 53081

[21] Appl. No.: 486,293

[22] Filed: Feb. 28, 1990

[51] Int. Cl.[5] ..... B30B 15/30; B30B 9/32

[52] U.S. Cl. ..... 100/49; 100/215; 100/902

[58] Field of Search ..... 100/902, 215, 218, 48, 100/49, 45

[56] References Cited

U.S. PATENT DOCUMENTS

| | | | |
|---|---|---|---|
| 2,558,255 | 6/1951 | Johnson et al. | 100/902 X |
| 3,062,130 | 11/1962 | Huber et al. | 100/902 X |
| 3,517,607 | 6/1970 | Keagle | 100/902 X |
| 4,459,906 | 7/1984 | Cound et al. | 100/902 X |
| 4,667,593 | 5/1987 | Kennedy | 100/902 X |
| 4,771,685 | 9/1988 | Wagner | 100/902 X |

FOREIGN PATENT DOCUMENTS

| | | | |
|---|---|---|---|
| 55-45534 | 3/1980 | Japan | 100/902 |
| 62-24896 | 2/1987 | Japan | 100/902 |
| 1-273696 | 11/1989 | Japan | 100/902 |

*Primary Examiner*—Harvey G. Hornsby
*Assistant Examiner*—Stephen F. Gerrity
*Attorney, Agent, or Firm*—Leon Gilden

[57] ABSTRACT

An apparatus including a disposal conduit mounted in underlying relationship to a tray. The tray includes an entrance opening in alignment with the conduit, and wherein the conduit includes a lowermost terminal end and an arcuate chute mounted to the lower terminal end of the conduit and directed downwardly and forwardly of the conduit and positioned to deposit an associated can forwardly of a reciprocatable ram. The ram is coaxially aligned with a support chute, wherein the support chute includes a forward terminal end spaced from a side wall of a surrounding housing a distance less than one-half a predetermined length of the associated can. A can deposited within the support chute actuates a switch to energize the ram and accordingly crushes the can to subsequently deposit the can in underlying storage compartment of the housing.

1 Claim, 4 Drawing Sheets

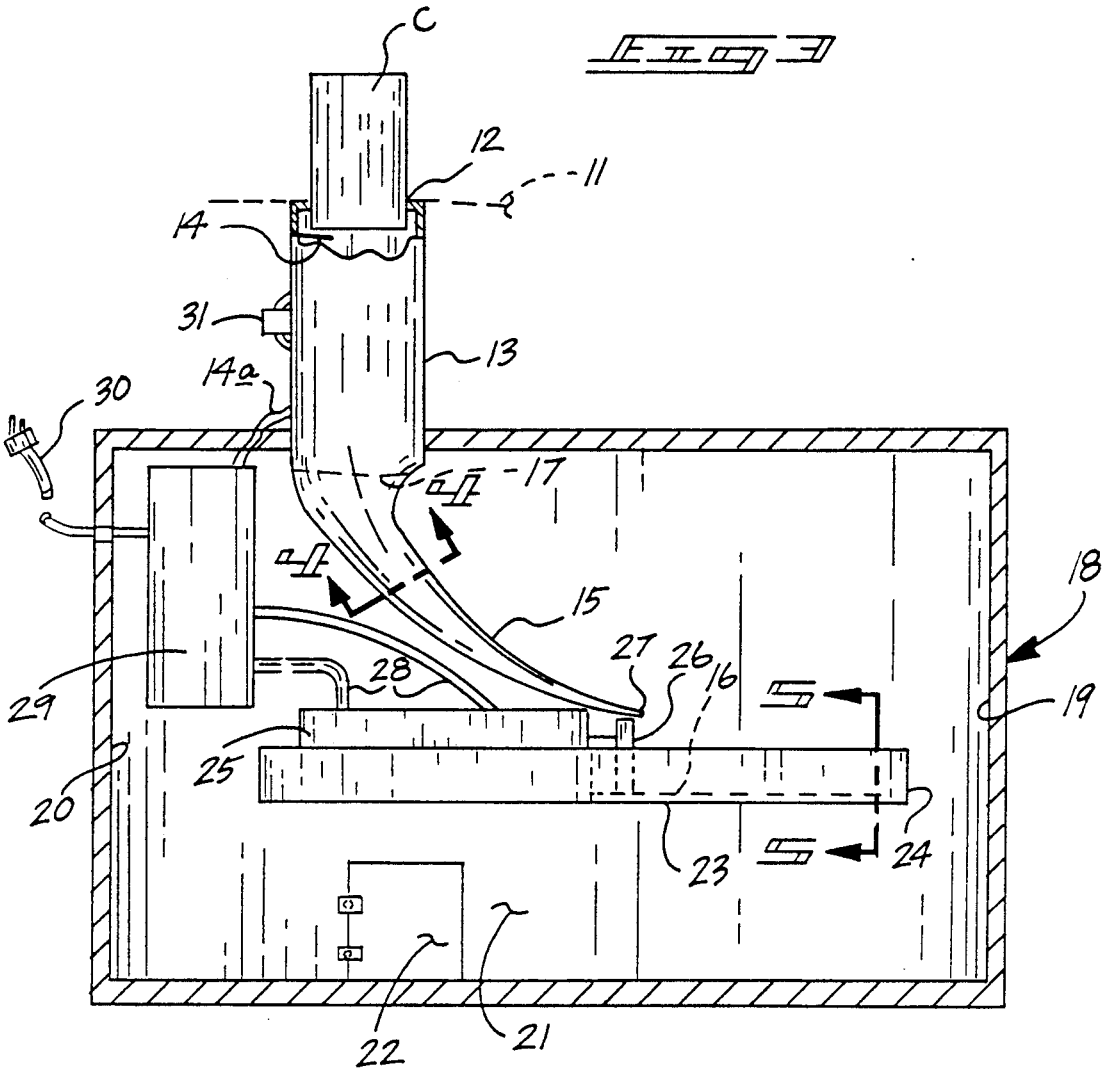
FIG 3
FIG 4
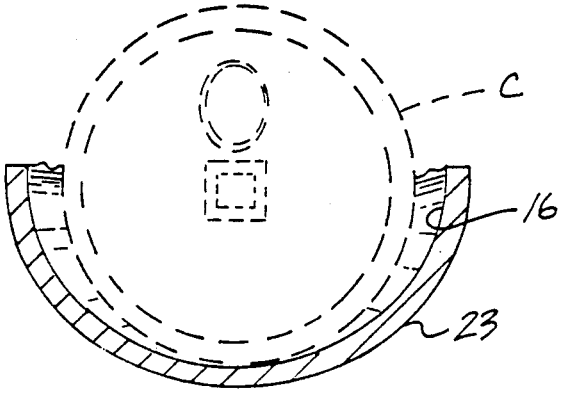

CAN DISPOSAL APPARATUS

BACKGROUND OF THE INVENTION

1. Field of the Invention

The field of invention relates to can disposal organizations, and more particularly pertains to a new and improved can disposal apparatus wherein the same permits reception and crushing of an associated can with subsequent deposit of the crushed can within a storage compartment of the associated housing.

2. Description of the Prior Art

Cans, and particularly aluminum cans, in contemporary usage are subject to recycling due to their cost of manufacture. Further, such cans require relative large expanses of space for storage subsequent to their recycling. The instant invention attempts to overcome deficiencies of disposal units of the prior art to efficiently and effectively arrange a can disposal unit in combination with a support tray, such as a counter top, to provide convenient and effective processing and storage of such cans. Examples of the prior art include U.S. Pat. No. 3,883,028 to Kittelson illustrates a typical trash receptacle organization in cooperation with a counter, wherein the receptacle includes a slotted lowermost terminal end to anchor the receptacle relative to a lower rail associated with the counter.

U.S. Pat. No. 4,032,037 to Dubery utilizes a bin for receiving various debris therewithin, where the lid is counter-weighted to be normally held in a closed orientation, with a catch means arranged to engage the lid when it is swung to an open position and hold the lid in the open position subsequent to disengagement of the catch means.

U.S. Pat. No. 4,453,648 to Harris, et al., sets forth a disposable container wherein an internal self-closing door flap will swing downwardly to allow objects to enter, and swing upwardly under gravity to close the chute.

U.S. Pat. No. 3,082,901 to Nakagawa provides for an ash tray disposal receiver with a chute member directed into an underlying repository for receipt of ashes associated with the chute.

U.S. Pat. No. 4,643,380 to Copeland includes a tapered enclosure with an opened end and a bottom support lid for mounting the support and lid selectively to the container.

As such, it may be appreciated that there continues to be a need for a new and improved can disposal apparatus which addresses both the problems of ease of use, as well as effectiveness in construction and in this respect, the present invention substantially fulfills this need.

SUMMARY OF THE INVENTION

In view of the foregoing disadvantages inherent in the known types of can disposal apparatus now present in the prior art, the present invention provides a can disposal apparatus wherein the same cooperates in association with a crushing mechanism to compact and effectively store a quantity of cans within a housing associated with the apparatus. As such, the general purpose of the present invention, which will be described subsequently in greater detail, is to provide a new and improved can disposal apparatus which has all the advantages of the prior art can disposal apparatus and none of the disadvantages.

To attain this, the present invention provides an apparatus including a disposal conduit mounted in underlying relationship to a tray. The tray includes an entrance opening in alignment with the conduit, and wherein the conduit includes a lowermost terminal end and an arcuate chute mounted to the lower terminal end of the conduit and directed downwardly and forwardly of the conduit and positioned to deposit an associated can forwardly of a reciprocatable ram. The ram is coaxially aligned with a support chute, wherein the support chute includes a forward terminal end spaced from a side wall of a surrounding housing a distance less than one-half a predetermined lenght of the associated can. A can deposited within the support chute actuates a switch to energize the ram and accordingly crushes the can to subsequently deposit the can in underlying storage compartment of the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can disposal apparatus which has all the advantages of the prior art can disposal apparatus and none of the disadvantages.

It is another object of the present invention to provide a new and improved can disposal apparatus which may be easily and efficiently manufactured and marketed.

It is a further object of the present invention to provide a new and improved can disposal apparatus which is of a durable and reliable construction.

An even further object of the present invention is to provide a new and improved can disposal apparatus which is susceptible of a low cost of manufacture with regard to both materials and labor, and which accordingly is then susceptible of low prices of sale to the consuming public, thereby making such can disposal apparatus economically available to the buying public.

Still yet another object of the present invention is to provide a new and improved can disposal apparatus which provides in the apparatuses and methods of the prior art some of the advantages thereof, while simultaneously overcoming some of the disadvantages normally associated therewith.

Still another object of the present invention is to provide a new and improved can disposal apparatus wherein the same is arranged and oriented in association with a support tray or counter to accommodate beverage containers to compact and store such containers subsequent to their deposit within the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic cross-sectional view of the instant invention.

FIG. 4 is an orthographic cross-sectional view of the support tray of the instant invention.

DESCRIPTION OF THE PREFERRED EMBODIMENT

Figure 1:
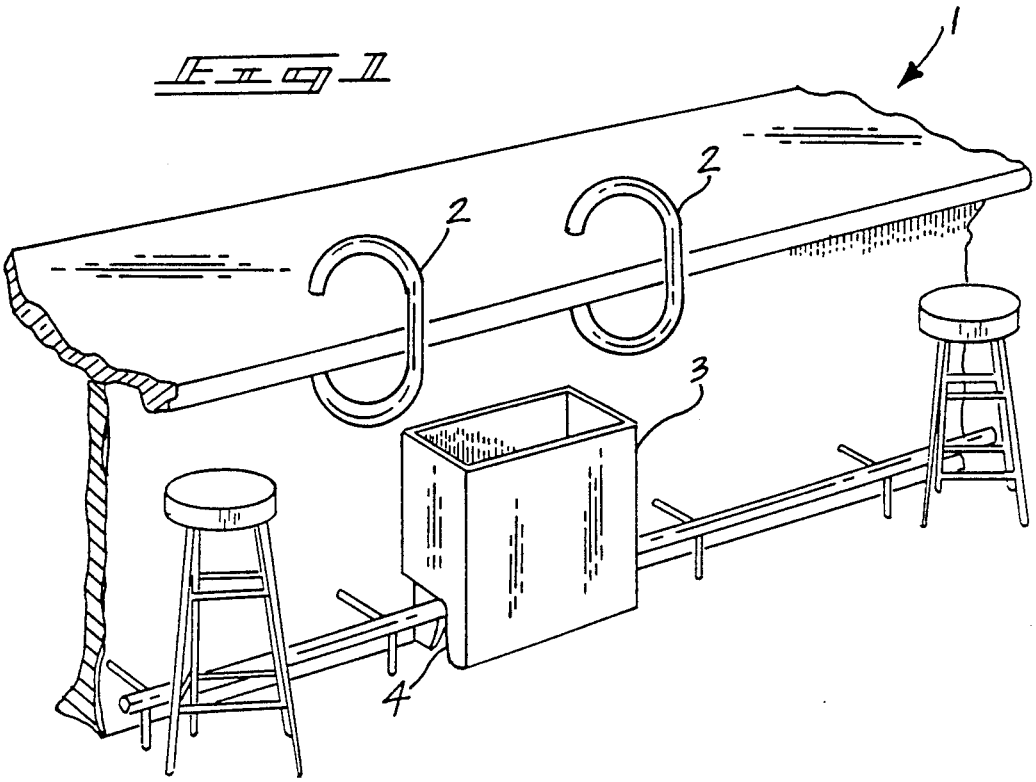
FIG. 1 is an isometric illustration of a prior art can disposal apparatus.
Figure 2:
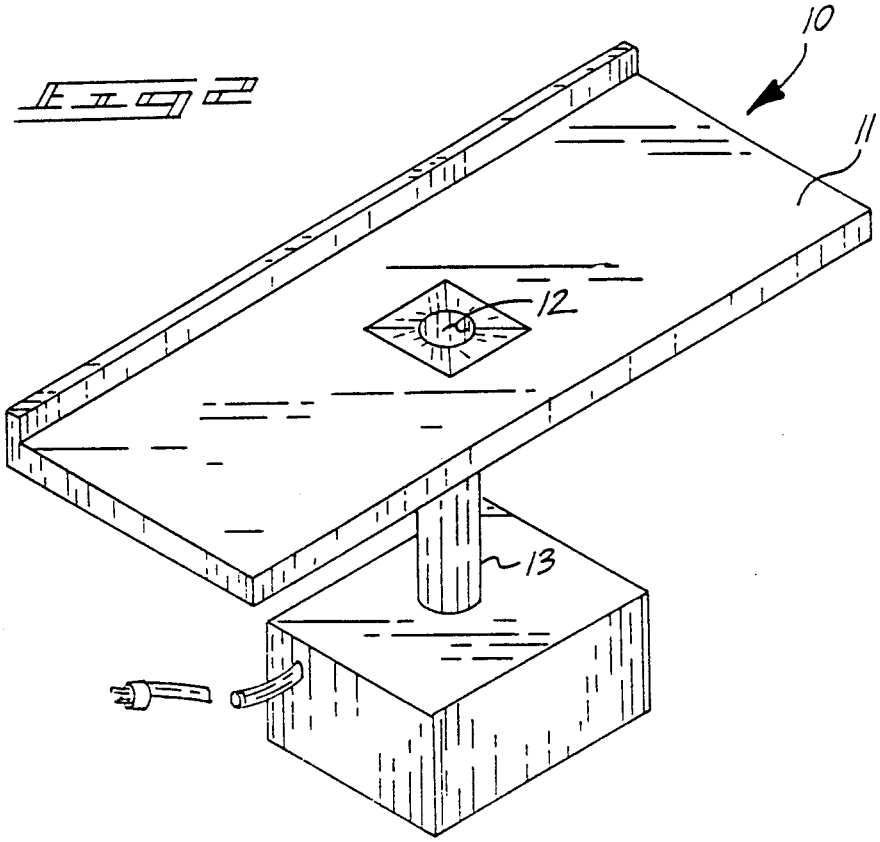
PRIOR ART FIG 2
FIG. 2 is an isometric illustration of the instant invention.

With reference now to the drawings, and in particular to FIGS. 1 to 8 thereof, a new and improved can disposal apparatus embodying the principles and concepts of the present invention and generally designated by the reference numeral 10 will be described.

FIG. 1 illustrates a prior art can disposal apparatus 1 wherein a counter utilizes a plurality of spaced rails 2 to define a disposal station therebetween, with a deposit container 3 mounted underlying the rails, with a slot 4 formed within a lowermost terminal end of the container for anchoring the container to a horizontal rail associated with the counter of the organization.

Figure 5:
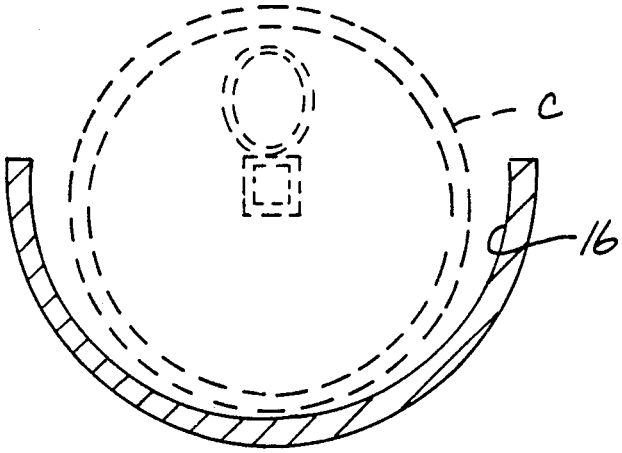
FIG. 5 is an orthographic cross-sectional view of the support tray of the instant invention at a forwardmost orientation relative to its reception of an associated can.
Figure 6:
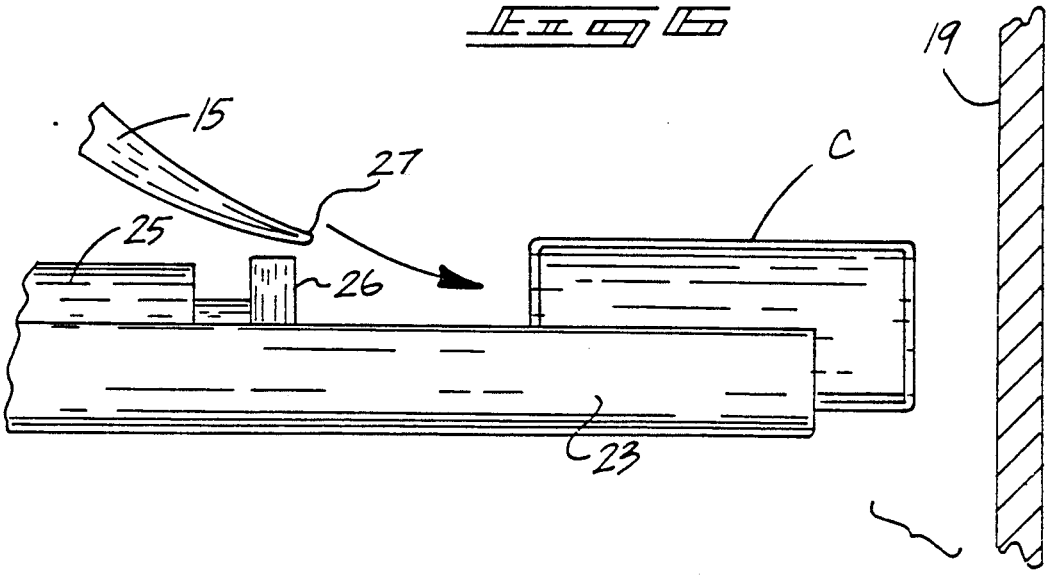
FIG. 6 is an orthographic side view, taken in elevation, of a can deposited within the support tray of the instant invention.
Figure 7:
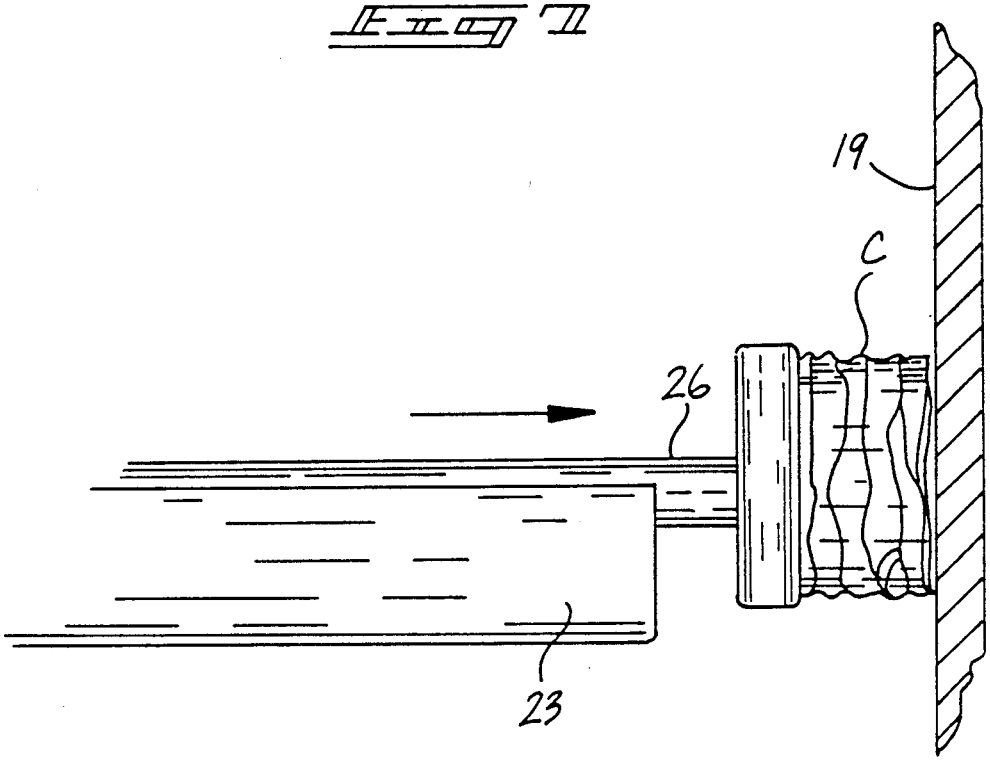
FIG. 7 is an orthographic side view, taken in elevation, of a can in a crushed configuration by the ram structure of the instant invention.
Figure 8:
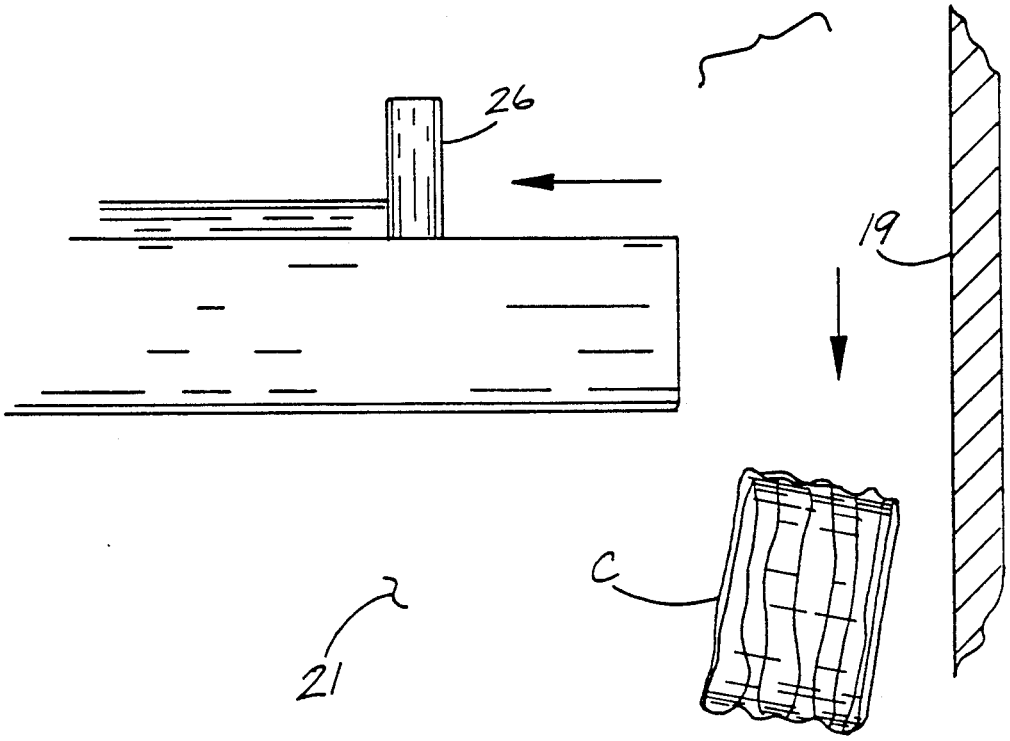
FIG. 8 is an orthographic view of the ram in a retracted position and the associated crushed can deposited within the associated storage compartment of the instant invention.

More specifically, the can disposal apparatus 10 of the instant invention essentially comprises a counter top 11 formed as part of a serving organization, wherein a conduit entrance opening 12 is formed through the counter top 11 associated in alignment with a vertical conduit 13. The conduit 13 includes a lower exit opening 17 coaxially aligned with the entrance opening 12. An arcuate chute 15 is directed downwardly and forwardly of the conduit 13, and includes a lower edge 27 positioned in a spaced relationship above a support shelf 23. The support shelf 23 is configured to include a horizontal, semi-cylindrical elongate support 16 that is tapered to a narrowed forward end portion, as illustrated in FIGS. 4 and 5 for example, to receive a can "C" is formed of a predetermined height. The exit opening 17 and support shelf 23 are enclosed within a housing 18 that includes a forward side wall 19 and a rear side wall 20. The forward side wall 19 is spaced from a forward shelf end 24 of the support shelf 23 a distance substantially equal to less than one-half the predetermined height of the can "C". The housing 18 defines a storage compartment 21 underlying the support shelf 23, with an access door 22 positioned for access interiorly of the storage compartment 21 to remove can "C" deposited within the storage compartment 21. A hydraulic or pneumatically operative cylinder 25 is coaxially aligned with the semi-cylindrical horizontal support 16, and positioned rearwardly of the lower edge 27 of the chute 15. A reciprocatable hydraulic or pneumatic ram 26 includes an enlarged head member that is positioned substantially underlying the forward lower edge 27 of the chute 15, as illustrated. Hydraulic lines 28 are operative with an electro-hydraulic power source 29 driving power from an electrical power supply line 30 to reciprocate the ram. A switch lever 14 normally biased in a horizontal orientation relative to the vertically oriented conduit 13 is positioned adjacent the conduit entrance opening 12 and extends into the conduit 13 medially thereof, wherein a can "C" directed within the entrance opening 12 deflects the switch lever 14 to actuate the electro-hydraulic power source 29 after a predetermined time delay effected through the timer 31 to delay actuation of the ram 26 to permit a can "C" deposited within the conduit 13 adequate time to be deposited upon the horizontal semi-cylindrical support 16. The forward shelf end 24 being positioned from the rear surface of the forward side wall 19 a distance substantially less than half the predetermined height of the can "C" requires the ram 26 to extend to its forwardmost position, as illustrated in FIG. 7, to permit crushing of the can "C" between the ram 26 and the forward side wall 19, whereupon retraction of the ram 26 permits the can "C" to be deposited within the storage compartment 21 for subsequent removal.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can disposal apparatus operative in association with an elongate cylindrical can, wherein the can is defined by a predetermined height, and wherein the apparatus comprises, an elongate, horizontally oriented counter top, and a conduit underlying and intersecting the counter top through a conduit entrance opening defined by a predetermined diameter greater than a can diameter defined by the can, and the conduit overlying a horizontal support tray, wherein the conduit includes an exit opening formed at its lower terminal end, and a housing enclosure encompassing the support tray and the exit opening, and the housing including a forward wall and a side wall, and the support tray spaced from the forward wall of the housing, and the housing including a storage compartment underlying the support tray, and crushing means operative with the support tray to crush the can for subsequent deposit within the storage compartment, and wherein a forward end of the support tray is spaced a further distance from the forward wall of the housing a spacing less than one-half the predetermined height of the can, and wherein the exit opening of the conduit includes an arcuate chute integrally associated with the exit opening, and wherein the arcuate chute is directed downwardly and forwardly of the exit opening, and wherein the arcuate chute includes a lower edge spaced above the support tray, and wherein the crushing means includes a reciprocatable ram positioned underlying the forward edge of the arcuate chute in a retracted position, and wherein the ram is positioned forwardly of the forward edge of the arcuate chute adjacent the forward wall of the housing between the forward wall of the housing and the forward end of the support tray, and wherein the crushing means further includes an elongate cylinder coaxially aligned with the support tray, and wherein a power source is positioned within the housing and is operative to extend and retract the ram to the forward wall of the housing, and further including a switch lever positioned within the conduit normally biased in a horizontal orientation and positioned adjacent the entrance opening, wherein the switch lever is in electrical communication with a timer, wherein the timer actuates the power source for actuation of the ram upon directing of a can interiorly of the conduit through the entrance opening, and wherein the support tray is tapered to a narrowed forward end from a wider portion of the support tray adjacent to and underlying the forward edge of the arcuate chute to a narrowed forward portion to the support tray coincident with the forward end of the support tray, and wherein the housing includes an access door formed through the housing underlying the support tray to provide access to the storage compartment within the housing.

* * * * *